US008303076B2

(12) United States Patent
Lin et al.

(10) Patent No.: US 8,303,076 B2
(45) Date of Patent: Nov. 6, 2012

(54) SOLID INK JET PRINTHEAD HAVING A POLYMER LAYER AND PROCESSES THEREFOR

(75) Inventors: Pinyen Lin, Rochester, NY (US); John R. Andrews, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 429 days.

(21) Appl. No.: 12/611,984

(22) Filed: Nov. 4, 2009

(65) Prior Publication Data

US 2011/0102492 A1 May 5, 2011

(51) Int. Cl.
*B41J 2/15* (2006.01)

(52) U.S. Cl. ..... 347/20; 347/68; 347/69; 347/70; 347/71; 347/72; 156/60; 156/332

(58) Field of Classification Search ..... 347/20, 347/68–72; 156/60, 331.8, 332
See application file for complete search history.

(56) References Cited

U.S. PATENT DOCUMENTS

| | | | | |
|---|---|---|---|---|
| 4,169,006 | A * | 9/1979 | Matsubara et al. | 156/182 |
| 6,210,522 | B1 * | 4/2001 | Singh et al. | 347/50 |
| 6,302,523 | B1 | 10/2001 | Smith et al. | |
| 6,491,375 | B1 | 12/2002 | Fitch | |
| 7,258,428 | B2 * | 8/2007 | Reddy et al. | 347/68 |
| 7,798,628 | B2 * | 9/2010 | Kataoka et al. | 347/94 |
| 2004/0165028 | A1 * | 8/2004 | Ito et al. | 347/20 |
| 2006/0158486 | A1 * | 7/2006 | Bibl et al. | 347/68 |
| 2006/0176332 | A1 * | 8/2006 | Chikamoto | 347/20 |
| 2008/0149566 | A1 | 6/2008 | Messersmith et al. | |
| 2008/0274420 | A1 | 11/2008 | Song et al. | |
| 2008/0309735 | A1 * | 12/2008 | Watanabe | 347/71 |

OTHER PUBLICATIONS

Brown and Somers, "Mimicking Mussel Proteins, Scientists Develop Super-Adhesive from Dopamine," Oct. 19, 2007, American Association for the Advancement of Science. Retrieved from http://www.aaas.org//news/releases/2007/1019glue.shtml Jun. 15, 2009.

* cited by examiner

*Primary Examiner* — Ryan Lepisto
*Assistant Examiner* — Guy Anderson
(74) *Attorney, Agent, or Firm* — Maginot, Moore & Beck, LLP

(57) ABSTRACT

A printhead assembly includes a plurality of functional plates bonded together in a stack by polymeric adhesive(s). The surfaces of the functional plates that contact the polymeric adhesives are subjected to a coating process that includes providing a coating of an adhesion promoter, namely polydopamine, prior to application of the adhesive. The adhesive may be a crosslinkable acrylic adhesive or a thermoplastic polyimide. The polydopamine coating is applied by immersing the functional plate in a buffered dopamine solution for a period sufficient to produce a coating having a pre-determined thickness. The thickness of the coating is controlled by submerging the functional plate in the buffered dopamine solution while the pH value of the dopamine solution is maintained at a value sufficient for polymerization of the dopamine during that time period, and then transferring the plates to a solution having a pH value that is insufficient to sustain the polymerization reaction.

15 Claims, 3 Drawing Sheets

DOPAMINE

SOLID INK JET PRINTHEAD HAVING A POLYMER LAYER AND PROCESSES THEREFOR

TECHNICAL FIELD

The present disclosure relates to the construction of multiple layer printheads, such as printheads used in solid ink jet printing machines. More particularly, the disclosure concerns the manner in which the multiple layers are adhered together in fabricating the printhead.

BACKGROUND

Solid ink jet printing machines include printheads that include one or more ink-filled channels communicating at one end with an ink supply chamber or reservoir and having an orifice at the opposite end, commonly referred to as the nozzle. An energy generator, such as a piezo-electric transducer, is located within the channels near the nozzle to produce pressure pulses. Another type system, known as thermal ink jet or bubble jet, produces high velocity droplets by way of a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble.

One example of a printhead assembly for solid ink printing machines is shown in FIG. 1. The assembly 10 comprises a series of functional plates, each performing an ascribed function for controlled dispensing of the molten ink onto a substrate passing by the assembly. In a particular embodiment, the printhead assembly 10 includes a jetstack plate assembly 11, a piezo-electric transducer plate 13 carrying PZT slabs 12, a stand-off plate 14, a circuit board 15, a diverter plate 17, a manifold plate 19 and a compliant outer wall 20. The stack for the printhead assembly 10 may also include a discrete adhesive layer 16 that adheres the diverter plate 17 to the circuit board 15, and an adhesive layer 18 that adheres the diverter plate 17 to the manifold 19.

The plates a typically formed of aluminum and/or stainless steel. In some printhead assemblies, the metallic plates are brazed together. However, improved printheads have utilized polymer adhesive films to join the metal components of the stack. In particularly, an adhesive film is applied between adjacent printhead components and the stack is heated and compressed until the adhesive cures. One adhesive commonly used adhesive is a thermoset acrylic polymer known as R1500. It has been found that polymer films, such as the R1500 film, may have a less than optimal interface between the polymer and the metal itself so that the adhesive interface may shear under higher loads.

Consequently there is a need for an improved interface between the adhesives used to fix a printhead stack together and the metal plates in the stack.

SUMMARY

In order to address this need, an adhesion promoter is provided that improves the adhesion between the polymer film and the metal plate components of the printhead assembly. In one embodiment, the surface of a metal component is coated with polydopamine. The polymer adhesive is then applied to the coated component. The polydopamine enhances the adhesion of the polymer adhesive to the metal, resulting in increased lap shear strength and increases failure load.

In one embodiment, a method for fabricating a printhead assembly for a solid ink jet printing machine in which the printhead includes a plurality of functional plates stacked together, comprises coating adjacent functional plates with an adhesion promoter layer, applying an adhesive to the adhesion promoter layer of the functional plates, and forming the stack of functional plates with the coated functional plates.

In one aspect, the step of coating adjacent functional plates with an adhesion promoter layer includes providing a buffered dopamine solution at a pH value suitable for supporting polymerization of the dopamine, and immersing at least one of the functional plates for a time period suitable for coating the plate with a polydopamine layer having a pre-determined thickness. The buffered dopamine solution may have an initial pH value of about 8.5. Under oxidizing conditions the dopamine forms a polydopamine layer on the immersed component. The pH is maintained for an amount of time sufficient to produce a desired polydopamine coating thickness, after which the pH value is adjusted to a value, such as about 7.0, sufficient to halt the thickness growth.

DETAILED DESCRIPTION

Figure 1:
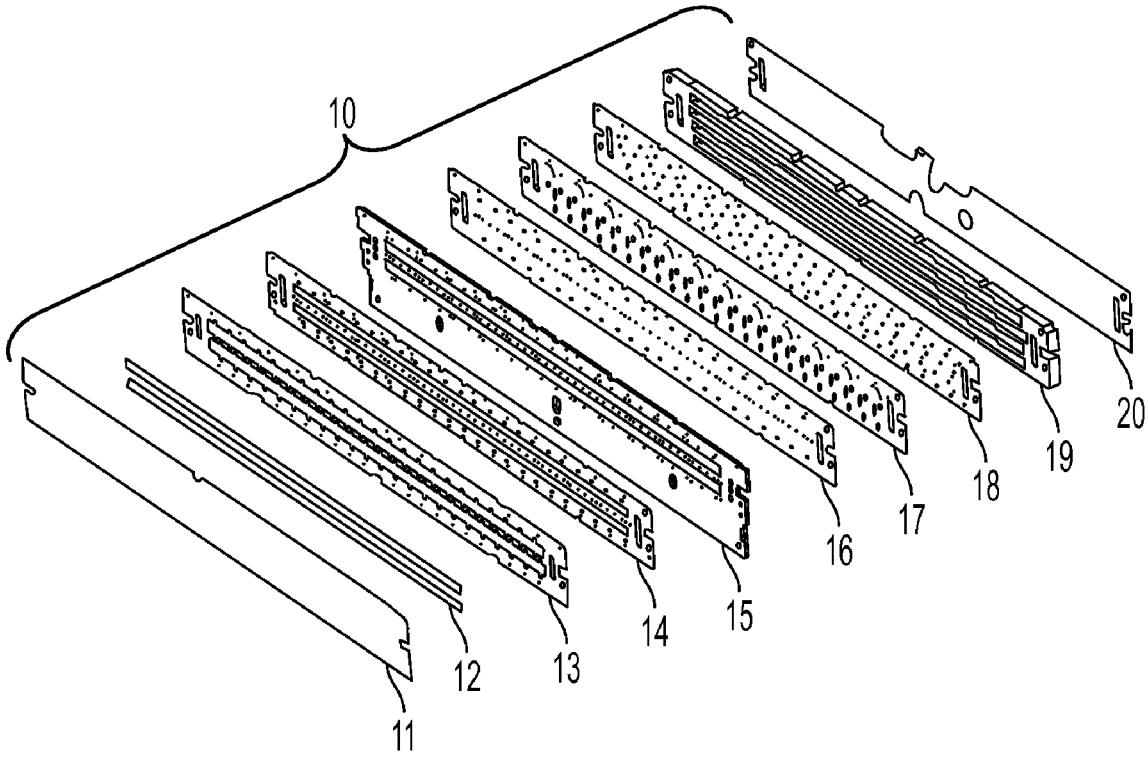
FIG. 1 is an exploded view of the components of a printhead suitable for use in a solid ink printing machine.
Figure 2:
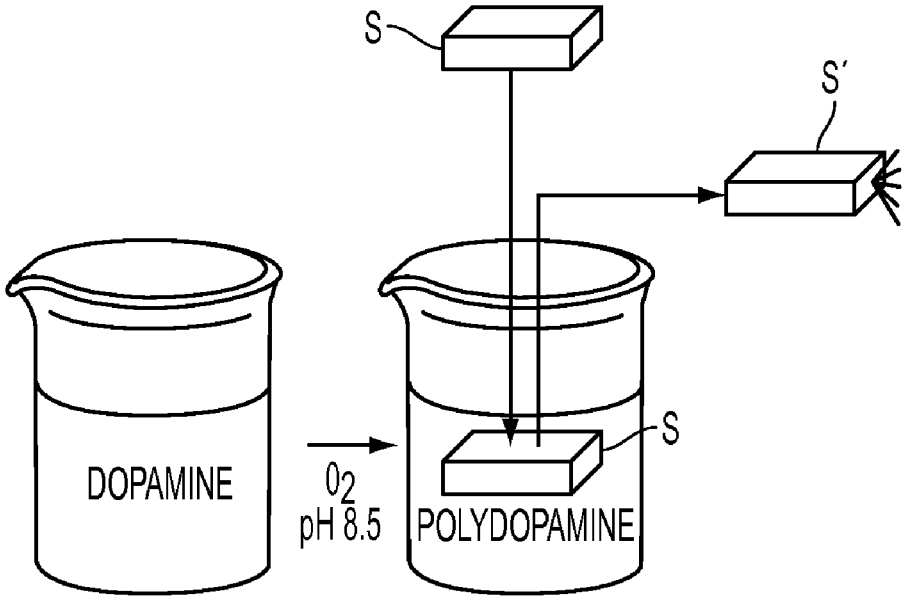
FIG. 2 is a representation of the formation of a polydopamine coating according to one disclosed embodiment.
Figure 4:
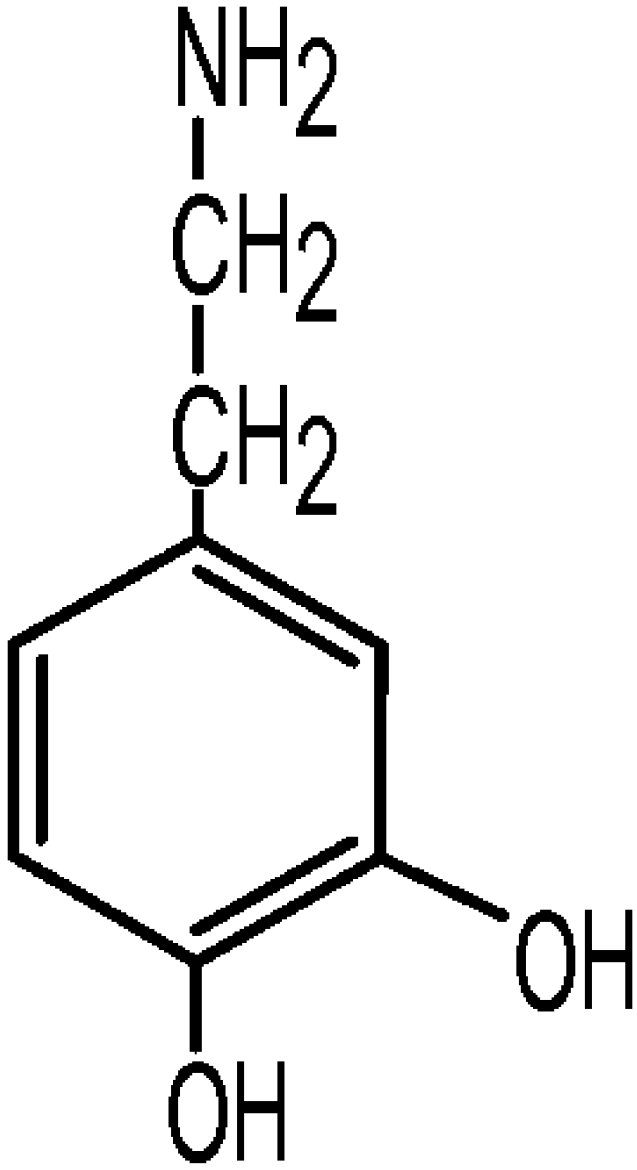
FIG. 4 is a diagram of the chemical structure of dopamine.

In one embodiment, a buffered solution of dopamine is used to produce a polydopamine coating on a metallic substrate, such as a metal component of the printhead assembly 10. In one specific embodiment, a hydroxytyramine hydrochloride dopamine (chemical structure shown in FIG. 4), obtained from Sigma-Aldrich Co., is buffered with a Tris buffer solution (100 mM TrisHCL, 500 mM NaCl) obtained from Teknova, Inc. The dopamine is diluted 10:1 (2 mg to 1 mL ratio) in the Tris buffer to a pH value of about 8.5, as depicted in FIG. 2. The substrate S is cleaned, such as by ultrasonic cleaning and $O_2$ plasma spray, prior to being immersed in the buffered dopamine solution.

Figure 3:
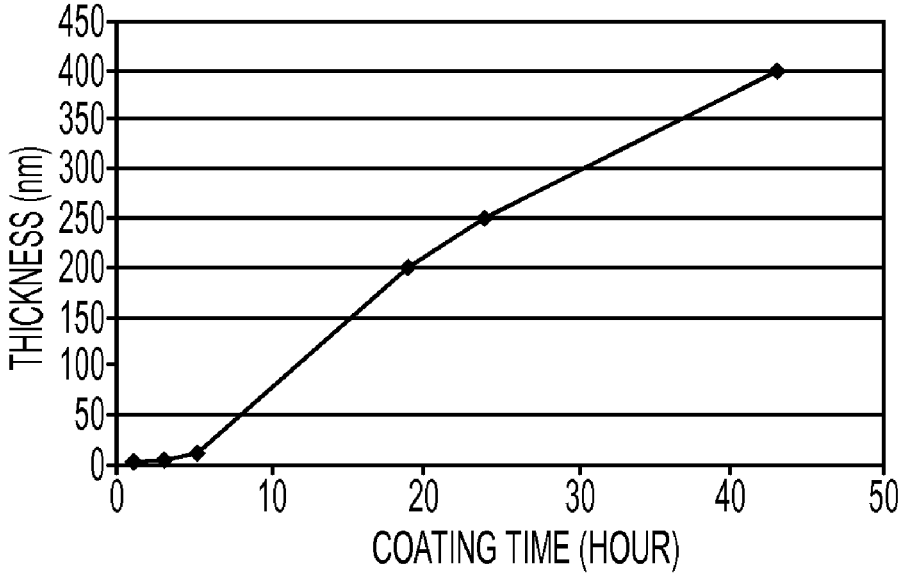
FIG. 3 is a graph showing coating thickness growth of the polydopamine coating as a function of coating time.

The substrate S is immersed in the buffered dopamine solution for a time period necessary to produce a desired polydopamine coating thickness. The coating thickness is a function of immersion time as shown in the graph of FIG. 3. The pH value of the solution is preferably maintained at about 8.5 during that time period to facilitate the polymerization process for the dopamine. When the coating time for the desired thickness is reached, the action of the dopamine is quenched by reducing the pH value of the solution below the pH value necessary to achieve polymerization of the dopamine. It has been found that reducing the pH value to about 7.0 by diluting with a suitable lower pH solution, such as sodium chloride, is sufficient to quench the polydopamine coating process. The coated substrate S' is then removed and air dried at room temperature.

It is desirable that the thickness of the adhesion promoter layer be sufficient to cover all of the surface topography of the printhead components and to provide an optimal interface between the polydopamine and the polymer adhesive. On the other hand, the polydopamine layer should not be so thick as to unnecessarily increase the thickness of the component stack for the printhead assembly. In certain embodiments, it has been found that a preferred thickness is between about 7 nm and about 60 nm, which correlates to a coating time of between about 4-9 hours, as reflected in the graph of FIG. 3.

In the construction of the printhead 10, each of the metallic layers, such as the diverter plate 17 and manifold 19, is coated with an adhesion promoter, such as the polydopamine as described above. The polymer adhesive is then applied to the coated components prior to assembly. The polymer adhesive may be a crosslinkable acrylic adhesive, or a thermoplastic polyimide, for example. In the examples herein, the polymer adhesive is R1500 adhesive.

The assembly is preferably maintained at an optimum temperature and pressure to perfect the polydopamine-adhesive interface and then to cure the adhesion of the polydopamine-adhesive interface to the metallic substrates being joined. In specific tests, stainless steel test strips were coated and then joined using strips of R1500 adhesive at 196° C. and 95 psi for 70 minutes. The appropriate conditions for a particular adhesive and substrate may vary from this example, and may be readily determined experimentally or empirically.

Strength tests were conducted using ten lap-shear samples. Four control samples were not treated with the polydopamine adhesion promoter. Instead, stainless steel strips were bonded only with the R1500 adhesive. In the remaining six samples, stainless steel strips were bonded using the polydopamine adhesion promoter and the R1500 adhesive described above. Three of these samples were immersed in the dopamine solution for eight hours to generate a coating thickness of about 60 nm. Another three samples were immersed in the dopamine solution for three hours, thereby producing a thinner coating of about 7 nm.

The control, or untreated, samples produced an average lap shear strength of about 1758 psi. The test samples with the 60 nm polydopamine coating produced an average lap shear strength of about 1994 psi. The thinner polydopamine coating of 7 nm yielded a greater average lap shear strength of about 2041 psi. Each treated sample exhibited a lap shear strength greater than the untreated samples.

Prior to testing it was unclear whether the polydopamine would retain its adhesion promoting characteristics under the high processing temperatures (almost 200° C.). As the above-described results reveal, the polydopamine coating was not degraded at the high temperatures. This result also demonstrates that the polydopamine coating can withstand the high operational temperatures (up to about 250° C.) of the printhead assembly 10.

In addition, it was uncertain whether the polydopamine layer would interfere with the ability of the adhesive to cure. In the illustrated embodiment, the adhesive R1500 is a crosslinkable acrylic polymer. As the above-described test results reveal, the polydopamine did not have an adverse effect on the crosslinking reaction of the R1500 adhesive.

The polydopamine coating may be applied to any of the components that are adhered together to form the printhead assembly, most particularly components adhered with a polymer adhesive. The polydopamine coating is particularly effective as an adhesion promoter for bonded metal components, such as the stainless steel and aluminum components of the printhead 10. Other components of the printing machine may also benefit from the adhesion promoting characteristics of the polydopamine coating disclosed herein.

It is contemplated that the adhesion promoter coating will be effective for various crosslinkable acrylic adhesives, such as the R1500 adhesive described herein. It is further contemplated that the adhesion promoter coating may be effective for other thermoset adhesives, such as silicone, epoxy, bismaleimide, phenolic resin and thermoplastic polyimide, for example.

It is also contemplated that the adhesion promoter may be useful for printheads constructed of materials other than the aluminum or stainless steel disclosed herein. For example, it is contemplated that the adhesion promoter coating may be beneficially applied to non-metallic surfaces, such as formed of polyimide, polyetherimide, polyetherether ketone, polysulfone, polyamide, polyphenylenesulfides and liquid crystal polymers. The substrates may be provided in sheet form or as injection molded components. It is further contemplated that certain ceramics, such as alumina, may also benefit from the adhesion promoter coating disclosed herein.

It will be appreciated that various of the above-described features and functions, as well as other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A printhead assembly comprising:

a plurality of functional plates stacked together;

an adhesive layer between adjacent functional plates for bonding the plates together; and a polydopamine coating applied to at least one functional plate prior to contact with the adhesive layer.

2. The printhead assembly of claim 1, wherein the polydopamine coating is applied by immersing the at least one functional plate in a buffered dopamine solution at a pH value of about 8.5.

3. The printhead assembly of claim 1, wherein the polydopamine coating has a thickness of between about 7 nm and about 60 nm.

4. The printhead assembly of claim 1, wherein the adhesive layer includes a crosslinkable acrylic adhesive.

5. The printhead assembly of claim 1, wherein the adhesive layer includes a thermoplastic polyimide.

6. The printhead assembly of claim 1, wherein the functional plates are formed of a metal, ceramic or plastic material.

7. A method for fabricating a printhead assembly for a solid ink jet printing machine in which the printhead includes a plurality of functional plates stacked together, comprising:

coating adjacent functional plates with a polydopamine layer;

applying an adhesive to the polydopamine layer of the functional plates; and forming the stack of functional plates with the coated functional plates.

8. The method for fabricating a printhead assembly of claim 7, wherein the step of coating adjacent functional plates with the polydopamine layer includes:

providing a buffered dopamine solution at a pH value suitable for supporting polymerization of the dopamine; and immersing at least one of the functional plates for a time period suitable for coating the plate with the polydopamine layer having a pre-determined thickness.

9. The method for fabricating a printhead assembly of claim 8, wherein the buffered dopamine solution is maintained at a pH value of about 8.5.

10. The method for fabricating a printhead assembly of claim 8, wherein the immersing step includes after the time period reducing the pH value of the buffered dopamine solution to a value that cannot support polymerization of the dopamine.

11. The method for fabricating a printhead assembly of claim 10, wherein the reduced pH value is about 7.0.

12. The method for fabricating a printhead assembly of claim 8, wherein the dopamine is buffered with Tris buffer in a 10:1 dilution.

13. The method for fabricating a printhead assembly of claim 8, wherein the pre-determined thickness is between about 7 nm to about 60 nm.

14. The printhead assembly of claim 7, wherein the adhesive is a crosslinkable acrylic adhesive.

15. The printhead assembly of claim 7, wherein the adhesive is a thermoplastic polyimide.

* * * * *